US006737643B2

(12) United States Patent
Torti et al.

(10) Patent No.: US 6,737,643 B2
(45) Date of Patent: May 18, 2004

(54) DETECTOR AND METHOD FOR CLUSTER ION BEAM DIAGNOSTICS

(75) Inventors: Richard P. Torti, Burlington, MA (US); Matthew C. Gwinn, Salem, MA (US); Jerald P. Dykstra, Austin, TX (US)

(73) Assignee: Epion Corporation, Billerica, MA (US)

( * ) Notice: Subject to any disclaimer, the term of this patent is extended or adjusted under 35 U.S.C. 154(b) by 440 days.

(21) Appl. No.: 09/811,904

(22) Filed: Mar. 19, 2001

(65) Prior Publication Data

US 2001/0054686 A1 Dec. 27, 2001

Related U.S. Application Data

(60) Provisional application No. 60/190,781, filed on Mar. 20, 2000.

(51) Int. Cl.[7] ..... H01J 49/26

(52) U.S. Cl. ..... 250/288; 250/281; 250/423 R; 250/305; 204/192.1; 204/192; 427/523

(58) Field of Search ..... 250/288, 281, 250/423 R, 305; 204/192.1, 192; 427/523

(56) References Cited

U.S. PATENT DOCUMENTS

| | | | | |
|---|---|---|---|---|
| 4,737,637 A | | 4/1988 | Knauer | 250/281 |
| 5,185,287 A | | 2/1993 | Aoyagi et al. | 437/105 |
| 5,382,793 A | | 1/1995 | Weinberger et al. | 250/288 |
| 5,459,326 A | | 10/1995 | Yamada | 250/398 |
| 5,659,170 A | | 8/1997 | Da Silveira et al. | 250/287 |
| 5,767,511 A | * | 6/1998 | Macler | 250/281 |
| 5,814,194 A | | 9/1998 | Deguchi et al. | 204/192.1 |
| 6,278,111 B1 | * | 8/2001 | Sheehan et al. | 250/288 |

FOREIGN PATENT DOCUMENTS

| | | |
|---|---|---|
| JP | 62112777 | 5/1987 |
| JP | 03245523 | 11/1991 |

OTHER PUBLICATIONS

Mack et al. "Gas Cluster Ion Beam Size Diagnostics and Workpiece Processing", pub. No. US/2002/0070361 A1, published Jun. 13, 2002.*

W. Henkes, et al., "Development of gas cluster ion accelerators", Rev. Sci. instrum., 48(6), (1997) p. 675.

N. Kofuji, et al., "Development of gas cluster source and its characteristics", Proc. 14$^{th}$ Symp. On Ion Sources and Ion–Assisted Technology, Tokyo (1991) p. 15.

Yamada & Matsuo, "Cluster ion beam processing", Matl. Science in Semiconductor Processing I, (1998) pp. 27–41.

N. Toyoda, "Nano–Processing with Gas Cluster Ion Beams", sections 3.1 and 3.2, doctoral thesis Kyoto Univ., Kyoto, JP, 1999.

* cited by examiner

*Primary Examiner*—John R. Lee
*Assistant Examiner*—Zia R. Hashmi
(74) *Attorney, Agent, or Firm*—Perkins Smith & Cohen; Jerry Cohen; John Hamilton

(57) ABSTRACT

A detector apparatus and its use for cluster ion beam diagnostics are described. The detector has a Faraday cup with a conductance path to a gas pressure detector and a conductance to the detector exit. The detector acquires ion current, which is a measure of the ion beam flux, and also acquires mass flux, through a pressure measurement. The pressure measurement responds to the mass of dissociated gas clusters and is combined with information about instantaneous ion current to estimate mean gas cluster ion size ($\bar{N}_i$).

51 Claims, 11 Drawing Sheets

DETECTOR AND METHOD FOR CLUSTER ION BEAM DIAGNOSTICS

CROSS REFERENCE TO RELATED APPLICATIONS

This application claims priority of the U.S. Provisional Application S. No. 60/190,781 filed Mar. 20, 2000 entitled CLUSTER SIZE MEASUREMENT INSTRUMENT AND METHOD FOR CLUSTER ION BEAM DIAGNOSTIC.

BACKGROUND OF THE INVENTION

This invention relates generally to measurement of gas cluster size, and, more particularly to measurement of mean gas cluster ion size.

The use of a gas cluster ion beam (GCIB) for etching, cleaning, and smoothing of the surfaces of various materials is known in the art (See for example, U.S. Pat. No. 5,814,194, Deguchi, et al., "Substrate Surface Treatment Method", 1998). For purposes of this discussion, gas clusters are nano-sized aggregates of materials that are gaseous under conditions of standard temperature and pressure. Such clusters typically consist of aggregates of from a few to several thousand atoms or molecules loosely bound to form the cluster. These clusters can be ionized by electron bombardment or other means, permitting them to be formed into directed beams of known and controllable energy. The larger sized clusters are the most useful because of their ability to carry substantial energy per cluster ion, while yet having only modest energy per atom or molecule. The clusters disintegrate on impact, with each individual atom or molecule carrying only a small fraction of the total cluster energy. Consequently the impact effects of large clusters are substantial, but are limited to a very shallow surface region. This makes ionized clusters effective for a variety of surface modification processes, without the tendency to produce deeper subsurface damage characteristic of monomer ion beam processing.

Means for creation of and acceleration of such GCIB's are described in the Deguchi reference previously cited. Presently available ionized cluster sources produce cluster ions having a wide distribution of sizes, N (where N=the number of molecules in each cluster—in the case of monatomic gases, an atom of the monatomic gas will be referred to as a molecule, or cluster of size N=1, and an ion of such a monatomic gas will be referred to as a molecular ion, or an ionized cluster of size N=1, or a cluster ion of size N=1, throughout the following discussion). The cluster formation process has been shown by N. Kofuji, et al. (in "Development of gas cluster source and its characteristics", *Proc. 14th Symp. on Ion Sources and Ion-Assisted Technology*, Tokyo (1991) p. 15) to produce few small size clusters (values of N from 2 to about 10), but molecular ions (N=1) are produced in abundance as are larger clusters (N greater than a few tens, up to several thousands.) It is known (U.S. Pat. No. 5,459,326, Yamada, "Method for Surface Treatment with Extra-Low-Speed Ion Beam", 1995) that atoms in a cluster are not individually energetic enough (on the order of a few electron volts) to significantly penetrate a surface to cause the residual sub-surface damage typically associated with the other types of ion beam processing in which individual monomer atoms may have energies on the order of thousands of electron volts. Nevertheless, the clusters themselves can be made sufficiently energetic (some thousands of electron volts), to effectively etch, smooth or clean surfaces as shown by Yamada & Matsuo (in "Cluster ion beam processing", *Matl. Science in Semiconductor Processing I*, (1998) pp 27–41).

To a first order approximation, the surface modification effects of an energetic cluster are dependent on the energy of the cluster. However, second order effects are dependent on the velocity of the cluster, which is dependent on both the energy of the cluster and it's mass (and hence the cluster size, N.) In order to maximize the utility of a GCIB for surface processing, it is useful to know and control both the energy of the clusters and the mean cluster size or the cluster size distribution. In certain applications gas cluster ion beams are used for deposition or growth of surface films. When so used, it is important to know the mass flow to the workpiece. The quantity of ions is readily determined by measuring the ion current that reaches the workpiece. Since it can be arranged so that the ionized clusters predominately carry a single electrical charge, it can be accurately assumed that each charge corresponds to a single ionized cluster or molecular ion, but unless the mean cluster size or cluster size distribution is known, the total mass flow to the target is not known. It is possible, by controlling the source conditions to influence both the ratio of cluster ions to molecular ions and the cluster size distribution (and thus the mean cluster size). However, unless a means is available to measure and monitor the mean cluster size or cluster size distribution, adjustment and control of the source to produce desired cluster sizes is difficult. For these and other reasons it is useful to have a measurement means that can provide information about cluster size in a gas cluster ion beam. A simple, compact, and inexpensive means of measuring the mean cluster mass in beam is desirable for diagnosing operation of a cluster source and ionizer.

In addition to cluster ions, a GCIB is likely to have a significant number of unionized clusters and molecules traveling with the ionized beam. Although a minor fraction of such unionized particles may include ions that have become neutralized through collisions, the majority consists of clusters and molecules that did not ionize while transiting the ionizer. Unionized clusters and molecules cannot be accelerated like ions, and consequently, have only thermal energy. These low energy unionized clusters and molecules do not participate substantially in processing a workpiece, but are indicative of the ionizer efficiency. For this reason, it is useful to have a measure of their magnitude.

Because molecular ions, as well as cluster ions, are produced by presently available cluster ion beam sources, molecular ions (cluster ions having N=1) are accelerated and transported to the workpiece being processed along with the cluster ions. Molecular ions, having high energy with low mass, have high velocities, which allow them to penetrate the surface and produce deep damage that is likely to be detrimental to the process. Such sub-surface ion damage is well established and well known from the more traditional monomer ion beam processing art and can produce a variety of damage and in implantation beneath the surface.

It has become known in the ionized cluster beam art that many GCIB processes benefit from incorporating means within GCIB processing equipment for eliminating molecular ions from the ionized cluster beams. Electrostatic (See for example U.S. Pat. No. 4,737,637, Knauer, "Mass Separator for Ionized Cluster Beam", 1988) and electromagnetic (For example, Japanese laid open application (kokai) 03-245523, Aoyanagi, et al., "Manufacture of Quantum Well Structure", 1991, cited as prior art in U.S. Pat. No. 5,185,287) mass analyzers have been employed to remove light ions from the beam of heavier clusters. Electrostatic and electromagnetic mass analyzers have also been employed to select ionized clusters having a narrow range of ion masses from a beam containing a wider distribution of masses (See previously cited U.S. Pat. No. 4,737,637 and also Japanese laid open application (kokai) 62-112777, Aoki, "Apparatus for Forming Thin Film", 1987).

Presently practical GCIB sources produce a broad distribution of ionized cluster sizes, but have limited cluster ion currents available. Therefore it is not practical to perform GCIB processing by selecting a single cluster size or a narrow range of cluster sizes—the available fluence of such a beam is too low for productive processing. It is preferred to reduce or eliminate the molecular ions from the beam and use the remaining heavier ions for processing.

It is therefore an object of this invention to provide a way of measuring the mean cluster ion size in GCIBs.

It is also an object of this invention to provide a way of measuring the mean cluster size present in a partially unionized GCIB.

Another object of this invention is to enable determining the relative quantities of ionized and unionized material in a GCIB.

One more object of this invention is to provide a means of measuring the molecular mass flow in a GCIB, both ionized and unionized.

It is a still further object of this invention to provide a GCIB processing system wherein mean cluster size measurement facilitates the operation, adjustment, and control of the processing system.

SUMMARY OF THE INVENTION

The objects set forth above as well as further and other objects and advantages of the present invention are achieved by the embodiments of the invention described hereinbelow.

This invention involves a detector and its use in measuring mean size of gas cluster ions in a beam. The detector includes an electron suppressed Faraday cup with a high conductance path to a neutral gas pressure detector (which can comprise a commercial compact ion pressure gauge) and a high conductance to the detector exit. The apparatus is both used to acquire ion current, which is a measure of the ion beam flux, and to acquire mass flux, through a pressure measurement. Since the pressure measurement responds to the completely dissociated clusters in real time, when combined with information about instantaneous ion current, the mean cluster ion size ($\overline{N}_i$) can be calculated.

For a better understanding of the present invention, together with other and further objects thereof, reference is made to the accompanying drawings and detailed description.

DETAILED DESCRIPTION OF THE PREFERRED EMBODIMENTS

The production, propagation, and utilization of energetic beams of clusters of gas molecules currently involve ionization of jets of coalesced neutrals. This gas stream produced by a supersonic expansion in a nozzle, results in a spectrum of cluster sizes. In addition, the process of ionization can alter the jet cluster size distribution. Certain material(s) surface processes facilitated by bombardment with cluster beams are sensitive to the distribution of cluster sizes. Additionally, knowing the efficiency of cluster formation is important for the development of nozzles and improvement of beam ionizers, beam transport systems and vacuum pumping systems for GCIB processors.

Figure 1:
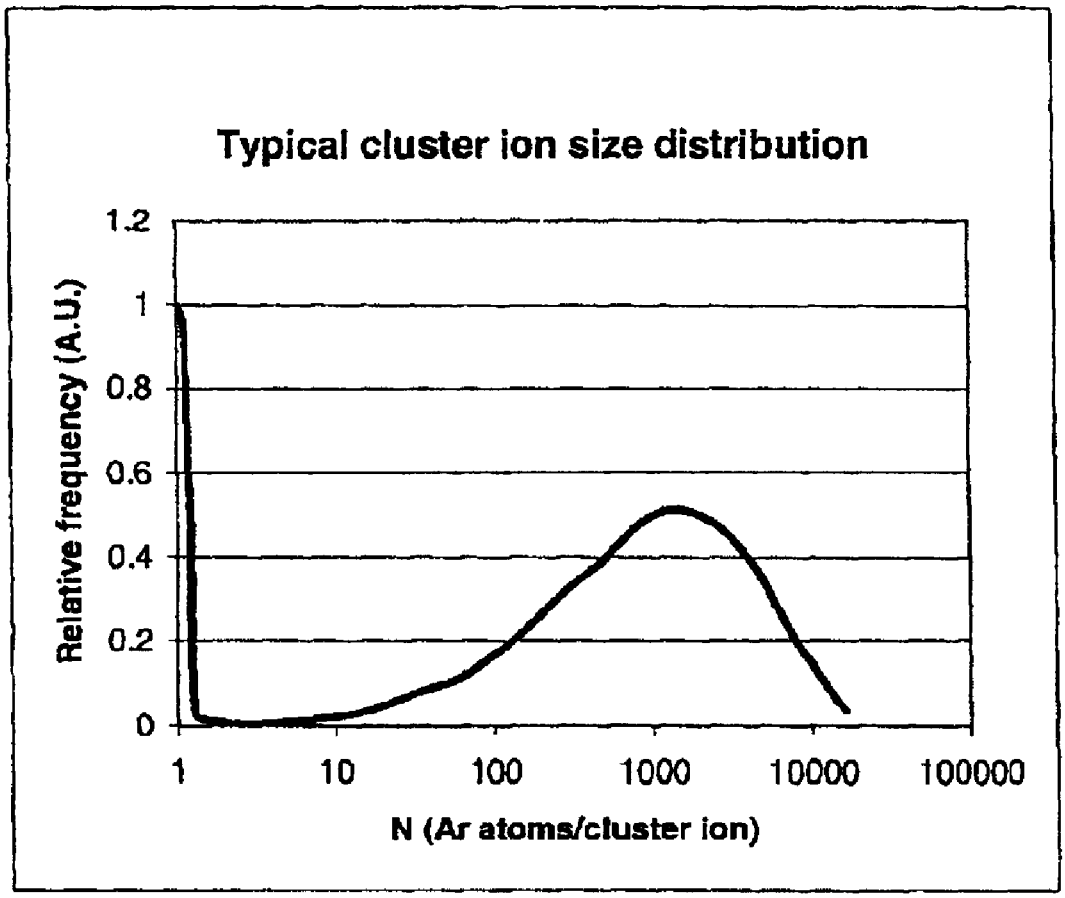
FIG. 1 is a graph showing a typical cluster ion size distribution for a GCIB from a typical source.
Figure 2:
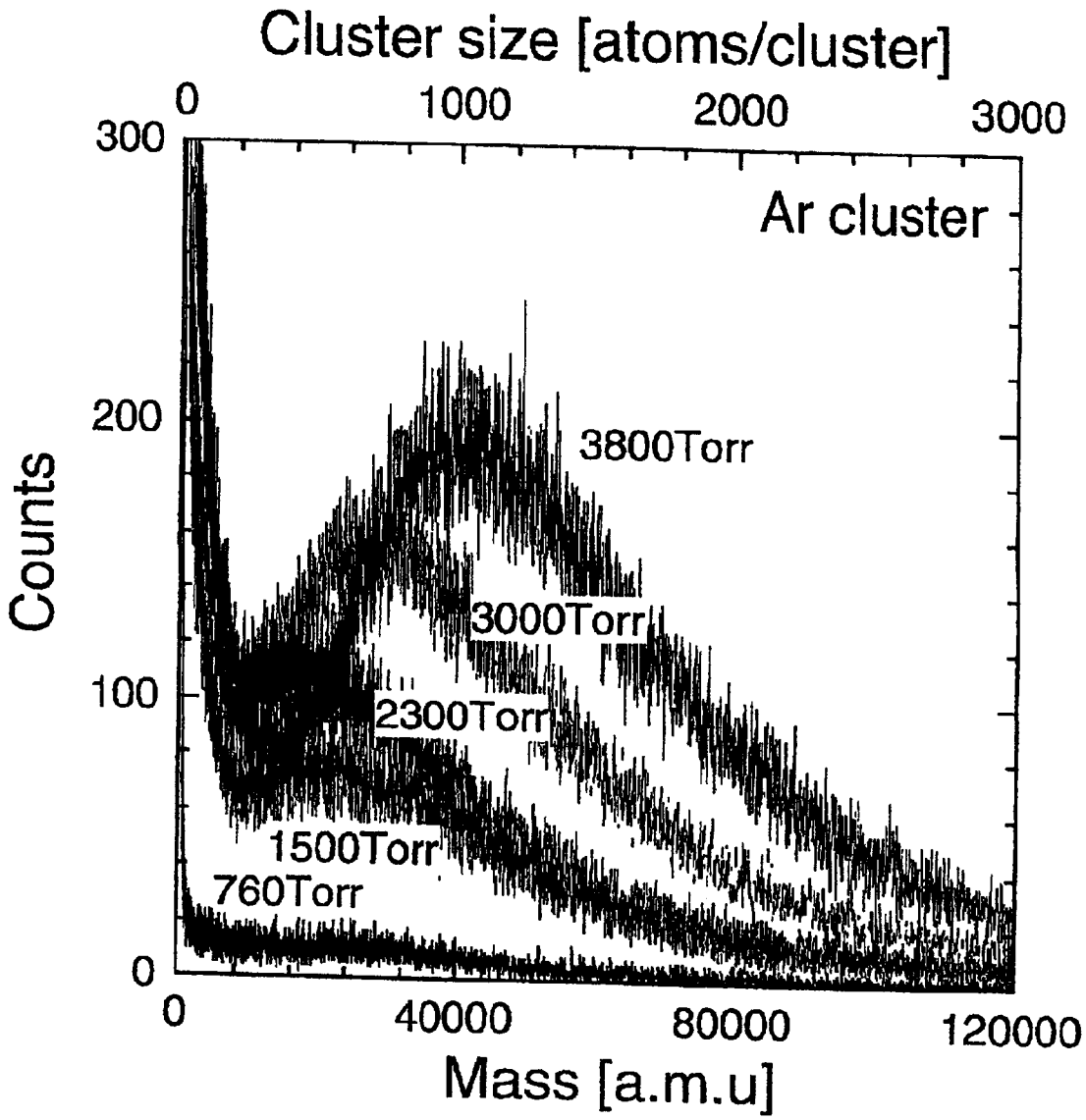
Figure 2. Prior Art
FIG. 2 is a prior art graph showing time-of-flight spectra of argon cluster ions for different source gas stagnation pressure conditions.

FIG. 1 shows one typical cluster ion size distribution curve for Argon clusters produced by a prior art GCIB system as has previously been manufactured by Epion Corp. For the particular set of conditions of nozzle shape and positioning relative to the gas skimmer aperture, the stagnation pressure, the ionization parameters, and other parameters used in this GCIB system the resulting cluster size distribution argon clusters has peaks near N=1 (molecular ions, or in this case since argon is a monatomic gas, atomic ions) and N=1500 (cluster ions). The distribution is a function of both the ionizer's operating conditions and the gas jet dynamics. In FIG. 2 (from N. Toyoda, "Nano-processing with gas cluster ion beams", doctoral thesis, FIG. 3.15, Kyoto Univ., Kyoto, JP, 1999), an example of the influence of nozzle stagnation pressure on cluster mass and cluster size distribution is shown for argon gas cluster ions.

Analysis of cluster mass or size distribution is carried out with a variety of methods in prior art. Imposition of an electrostatic retarding field, prior to acceleration, filters the ions according to their energy. Since the jet particles have nearly the same velocity, their energy corresponds to their mass. However, use of this method ignores acceleration and transport of the beam, which can distort cluster distribution. Additionally, well-defined fields must be established which may involve use of equipotential semi-transparent screens that are not desirable for beam transport.

Figure 3:
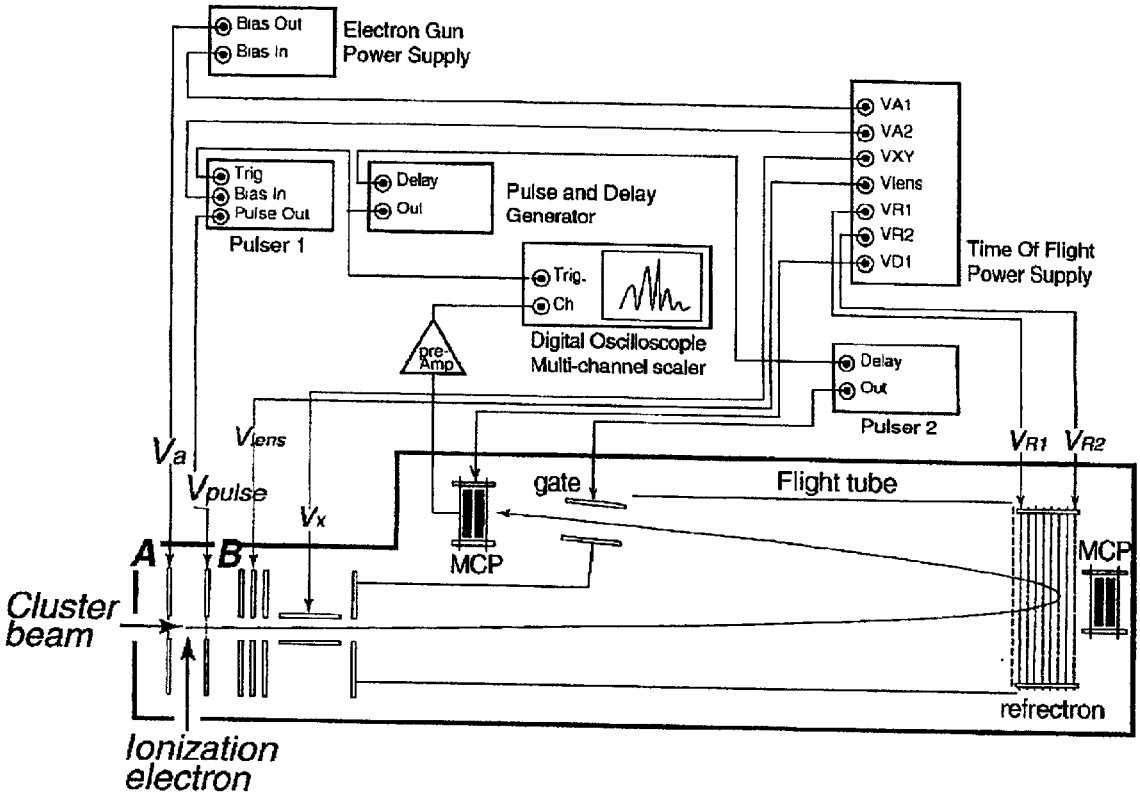
Figure 3. Prior art
FIG. 3 is a schematic diagram of a prior art time-of-flight mass spectrometer.

Alternatively, time of flight (TOF) methods allow an accelerated beam to be analyzed. A prior art TOF system is shown in FIG. 3 (from N. Toyoda, "Nano-processing with gas cluster ion beams", doctoral thesis, FIG. 3.2, Kyoto Univ., Kyoto, JP, 1999). TOF methods are usually complicated and expensive and require significant allocation of space for the hardware.

Figure 4:
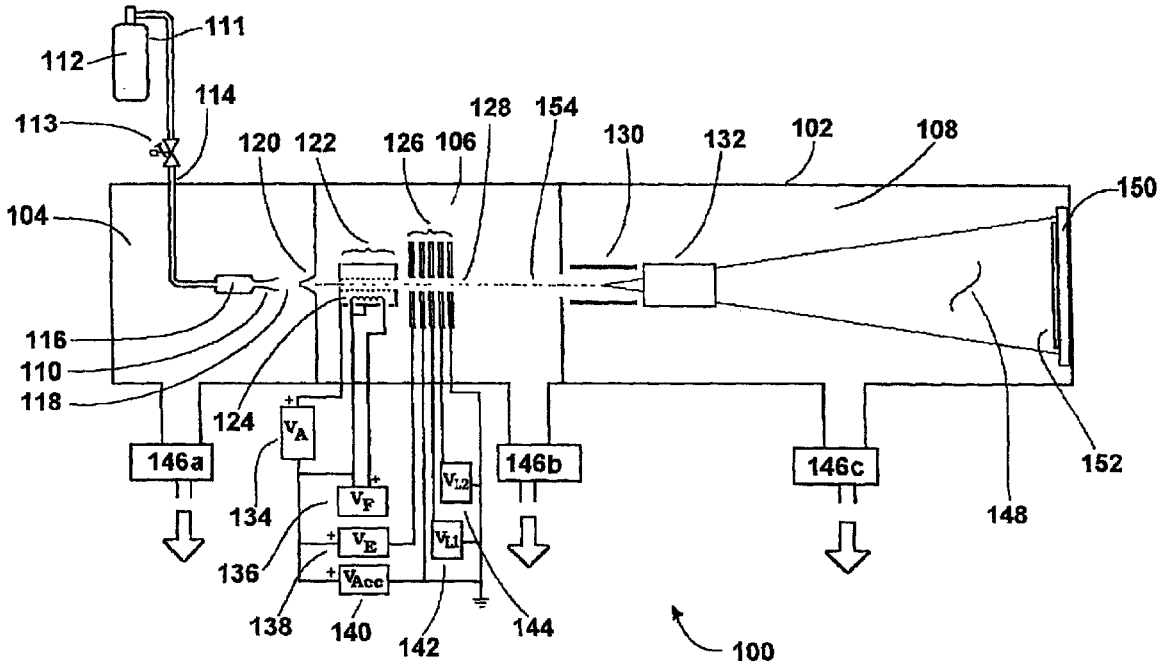
Figure 4. Prior Art
FIG. 4 is a schematic diagram showing the basic elements of a prior art GCIB processing system.

FIG. 4 shows a typical configuration for a GCIB processor 100 of a form known in prior art, and which may be described as follows: a vacuum vessel 102 is divided into three communicating chambers, a source chamber 104, an ionization/acceleration chamber 106, and a processing chamber 108. The three chambers are evacuated to suitable operating pressures by vacuum pumping systems 146*a*, 146*b*, and 146*c*, respectively. A condensable source gas 112 (for example argon or $N_2$) stored in a cylinder 111 is admitted under pressure through gas metering valve 113 and gas feed tube 114 into stagnation chamber 116 and is ejected into the substantially lower pressure vacuum through a properly shaped nozzle 110. A supersonic gas jet 118 results. Cooling, which results from the expansion in the jet, causes a portion of the gas jet 118 to condense into clusters, each consisting of from several to several thousand weakly bound atoms or molecules. A gas skimmer aperture 120 partially separates the gas molecules that have not condensed into a cluster jet from the cluster jet so as to minimize pressure in the downstream regions where such higher pressures would be detrimental (e.g., ionizer 122, high voltage electrodes 126, and process chamber 108). Suitable condensable source gases 112 include, but are not necessarily limited to argon, nitrogen, carbon dioxide, oxygen, and other gases.

After the supersonic gas jet 118 containing gas clusters has been formed, the clusters are ionized in an ionizer 122. The ionizer 122 is typically an electron impact ionizer that produces thermoelectrons from one or more incandescent filaments 124 and accelerates and directs the electrons causing them to collide with the gas clusters in the gas jet 118, where the jet passes through the ionizer 122. The electron impact ejects electrons from the clusters, causing a portion the clusters to become positively ionized. A set of suitably biased high voltage electrodes 126 extracts the cluster ions from the ionizer, forming a beam, then accelerates them to a desired energy (typically from 1 keV to several tens of keV) and focuses them to form a GCIB 128 having an initial trajectory 154. Filament power supply 136 provides voltage $V_F$ to heat the ionizer filament 124. Anode power supply 134 provides voltage $V_A$ to accelerate thermoelectrons emitted from filament 124 to cause them to bombard the cluster containing gas jet 118 to produce ions. Extraction power supply 138 provides voltage $V_E$ to bias a high voltage electrode to extract ions from the ionizing region of ionizer 122 and to form a GCIB 128. Accelerator power supply 140 provides voltage $V_{ACC}$ to bias a high voltage electrode with respect to the ionizer 122 so as to result in a total GCIB acceleration energy equal to $V_{ACC}$ electron volts (eV). One or more lens power supplies (142 and 144 shown for example) may be provided to bias high voltage electrodes with potentials ($V_{L1}$ and $V_{L2}$ for example) to focus the GCIB 128.

A workpiece 152, which may be a semiconductor wafer or other workpiece to be processed by GCIB processing, is held on a workpiece holder 150, disposed in the path of the GCIB 128. Since most applications contemplate the processing of large workpieces with spatially uniform results, a scanning system is desirable to uniformly scan the GCIB 128 across large areas to produce spatially homogeneous results. Two pairs of orthogonally oriented electrostatic scan plates 130 and 132 can be utilized to produce a raster or other scanning pattern across the desired processing area. When beam scanning is performed, the GCIB 128 is converted into a scanned GCIB 148, which scans the entire surface of workpiece 152.

Figure 5:
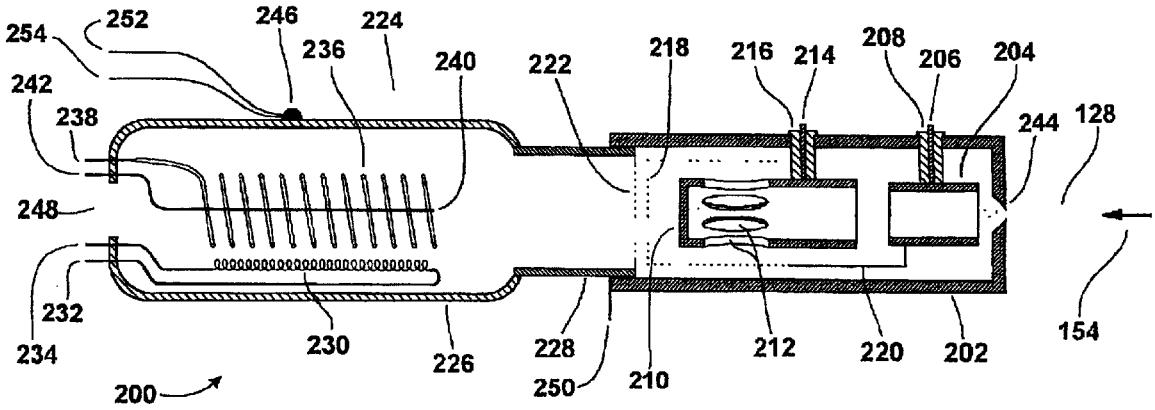
FIG. 5 represents a schematic diagram of an ionized cluster beam charge and mass detector apparatus of this invention.

The components of an embodiment of the cluster beam charge and mass detector apparatus 200 of the present invention are shown in FIG. 5. The detector apparatus includes an ion current collecting means enclosed within a conductive shield such as metal shield 202 and including an electron suppressor electrode 204, a collector Faraday cup 210, bypass ports 212 for gas flow into a pressure sensor 224 (which in this embodiment is a miniature Bayard-Alpert ion gage), an exit aperture 248 in the pressure sensor enclosure 226, and a temperature sensor 246 in thermal contact with the pressure sensor enclosure 226. Metal shield 202 has an electrical connector 250 for connecting an electrical bias (typically grounded). Suppressor electrode 204 has an electrical connector 206 that passes through insulating electrical feedthrough 208 to the outside of metal enclosure 202 for connection to an electrical bias (typically a negative potential). Faraday cup 210 has an electrical connector 214 that passes through insulating electrical feedthrough 216 to the outside of metal enclosure 202 for connection external current sensing means that is typically at a virtual ground potential. In operation, a GCIB 128 having a trajectory 154 directed at the entrance aperture 244, which is an opening in the metal shield 202 of the detector apparatus 200, enters the detector apparatus 200 and strikes the Faraday cup 210. It should be noted that the GCIB 128 may include both ionized and unionized molecules and clusters. The charge on the ions in the GCIB 128 is collected by the Faraday cup 210 and conducted via connector 214 to an external current sensing means. Upon striking the Faraday cup, clusters (both ionized and unionized) in GCIB 128 become dissociated into their constituent molecules (which are atoms in the case of a monatomic gas like argon) and the resulting gas flows through bypass ports 212 into the pressure sensor 224. A suppressor screen 218 is connected by lead 220 to suppressor electrode 204. Suppressor electrode 204 and suppressor screen 218 assure that electrons do not escape the Faraday cup 210, assuring accurate GCIB current collection. The grounded metal shield 202 is hermetically and electrically connected to the metal tubulation 228 of the pressure sensor 224. A grounded grid screen 222 between the pressure sensor 224 and the suppressor screen 218 establishes an electrical field between grid screen 222 and suppressor screen 218 that prevents stray electrons from the pressure sensor 224 from being collected by the Faraday cup 210. Grid screen 222 and suppressor screen 218 allow gas in the region enclosed by the metal shield 202 to flow freely into the pressure sensor 224. The pressure sensor 224 may be any of a variety of pressure sensors or gauges as are generally known to those who practice the art of low pressure measurements, provided that it has (or can be modified to have) appropriate pressure sensitivity and appropriate entrance and exit ports or openings, but in this embodiment is a miniature Bayard-Alpert ion gauge (Granville Phillips model 343, for example). Pressure sensor 224 has a glass enclosure 226, with a metal tubulation 228. The duct in the metal tubulation 228 serves as the gas entrance port, and an exit aperture 248 is added by drilling a circular hole in the base of the normally closed glass enclosure 226 of the Granville Phillips model 343. The internal elements of the pressure sensor 224 are the filament 230 having connectors 232 and 234, the spiral anode grid 236 having connector 238, and the collector electrode 240, having connector 242. In operation the pressure sensor is connected to suitable external circuits to operate the sensor so as to provide a pressure measurement signal, which is responsive to the pressure within the sensor enclosure 226. Upon striking the Faraday cup, clusters (both ionized and unionized) in GCIB 128 become dissociated into their constituent molecules and the resulting gas flows through bypass ports 212 into the pressure sensor 224 where a pressure signal proportional to the quantity of molecules from the dissociated clusters is generated. A temperature sensor 246 having electrical connection leads 252 and 254 is in thermal contact with the pressure sensor enclosure 226 for measuring the temperature thereof. The temperature sensor 246 may be any of various types of sensor including thermocouple, thermistor, RTD, or others known in the art of electronic temperature measurement. In this embodiment, a two terminal monolithic integrated circuit temperature transducer (Analog Devices type AD592) is used for example and not for limitation. In operation, the temperature sensor 246 is electrically connected to suitable circuitry for measuring the temperature of the pressure sensor enclosure 226.

Figure 6A:
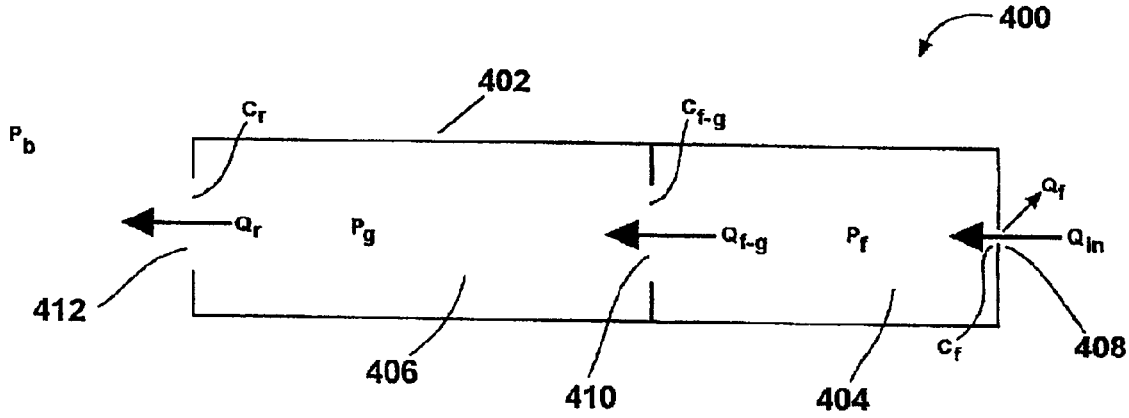
FIG. 6A is a mass flow diagram of an ionized cluster beam charge and mass detector apparatus of this invention.
Figure 6B:
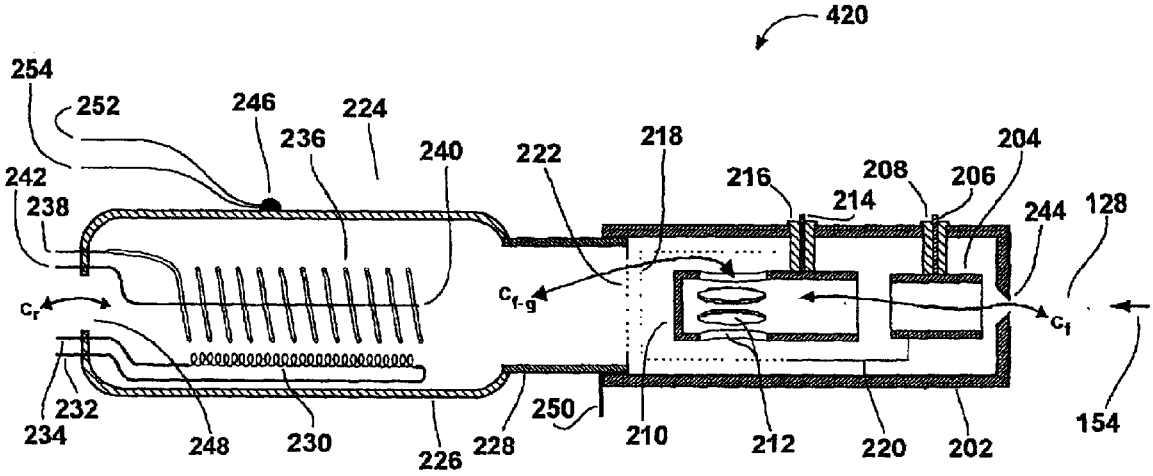
FIG. 6B represents a schematic of the ionized cluster beam charge and mass detector apparatus showing the conductances shown in FIG. 6A.

FIG. 6A is a block diagram model 400 of the ionized cluster beam charge and mass detector apparatus 200 showing the mass flows in the apparatus during operation. FIG. 6B represents a schematic diagram of the ionized cluster beam charge and mass detector apparatus 420 showing the conductances and other items related to the block diagram model 400 shown in FIG. 6A.

Referring to FIGS. 6A and 6B, the model has an enclosure 402 that corresponds to the enclosing envelope of the detector apparatus that is formed by the combination of metal shield 202, pressure sensor tubulation 228, and pressure sensor glass enclosure 226. The enclosure 402 contains two regions, a Faraday region 404, and a pressure sensor region 406. The two regions 404 and 406 are separated by an aperture 410 having conductance $C_{f\text{-}g}$ that represents the lumped constant equivalent of the flow restrictions between the interior of Faraday cup 210 and the pressure sensor 224 of the detector apparatus 200. The model has an entrance aperture 408 representing the lumped constant equivalent of the flow restrictions between the Faraday cup 210 and the exterior of the detector apparatus 200, through the entrance aperture 244, and having a conductance of Cf. The model has an exit aperture 412 representing the lumped constant equivalent of the flow restrictions between the pressure sensor enclosure 226 to the exterior of the detector apparatus 200, through the exit aperture 248, and having a conductance of $C_r$. The arrows $Q_{in}$, $Q_f$, $Q_{f\text{-}g}$ and $Q_r$ represent molecular mass flows and are defined hereinafter.

Referring to FIGS. 6A and 6B, incoming ions of different charge to mass ratios (cluster sizes) are accepted through a low conductance entrance aperture 408. After the ions traverse a secondary electron suppression field, current is detected on the collector Faraday cup 210. The suppression field is produced by a negative voltage applied between the electron suppressor electrode 204 and the Faraday cup 210 and serves to inhibit the entrance of any free electrons into the Faraday cup 210, or the exit of secondary electrons produced in the Faraday cup 210. The cluster ions, as well as molecular ions, upon striking the Faraday cup 210, become neutralized in the charge detection process, and dissociate into component neutral molecules. The neutral molecules form a gas that passes freely through the bypass ports 212 into the attached miniature Bayard-Alpert gas pressure sensor 224 where the neutral molecules are detected by their gas pressure. Pressure increase in the gas pressure sensor 224, resulting from the inflow of gas from the Faraday cup 210, causes a flow out through the exit aperture 248 into the lower pressure vacuum outside of the detector 200. This method allows detection of mean charge to mass ratio in real time by acquiring current and pressure. From this, a quantitative estimate of mean cluster size may also be obtained, when the incoming GCIB 128 does not include significant quantities of neutral particles. This can be seen from the following analysis with the help of FIG. 6A:

$Q_{in}$ represents the equivalent molecular mass flow into the detector as energetic molecules or clusters. It results from beam flux, and is not pressure driven.

$Q_f$ represents molecular mass flow between the detector and its exterior through the entrance aperture $Q_{f\text{-}g}$ represents molecular mass flow between the Faraday cup region and the pressure sensor (gauge) region $Q_r$ represents molecular mass flow between the pressure sensor (gauge) region and the exterior of the detector through the exit aperture $P_f$ represents the pressure in the Faraday cup region $P_g$ represents the pressure in the pressure sensor (gauge) region $P_b$ represents the ambient (background) pressure outside of the detector $C_f$ represents the conductance (a function of absolute temperature, T) determined for the flow regime in which the detector will operate (which will normally be the molecular flow regime) from the Faraday region to the exterior of the detector through the entrance aperture $C_{f\text{-}g}$ represents the conductance (a function of absolute temperature, T) determined for the flow regime in which the detector will operate (which will normally be the molecular flow regime) from the Faraday region to the pressure sensor (gauge) region $C_r$ represents the conductance (a function of absolute temperature, T) determined for the flow regime in which the detector will operate (which will normally be the molecular flow regime) from the pressure sensor (gauge) region to the exterior of the detector through the exit aperture $$Q_{in}=Q_f+Q_r \text{ (Input=Output)} \quad \text{Eqn.1}$$

$$Q_f=(P_f-P_b)C_f \text{ (Flow out from beam entrance aperture)} \quad \text{Eqn. 2}$$

$$Q_{f\text{-}g}=(P_f-P_g)C_{f\text{-}g}=Q_r \text{ (Flow into the pressure sensor (gage) region= Flow out from exit aperture)} \quad \text{Eqn. 3}$$

$$Q_r=(P_g-P_b)C_r \text{ (Flow out from beam downstream aperture)} \quad \text{Eqn. 4}$$

Since the conductances can be calculated or experimentally determined, and the $P_g$ is the pressure read by the pressure sensor, it follows that $Q_{in}$ can be expressed in terms of known quantities and can be reduced to:

$$Q_{in}=P_g(C_f+C_r+C_rC_f/C_{f\text{-}g})+P_b(C_f+C_r+C_rC_f/C_{f\text{-}g}) \quad \text{Eqn. 5}$$

If the background pressure $$P_b<<P_g, \quad \text{Condition 1}$$

and $$P_b<<P_f, \quad \text{Condition 2}$$

then the expression approximates to:

$$Q_{in}=P_g(C_f+C_r+C_rC_f/C_{f\text{-}g}) \quad \text{Eqn. 6}$$

In addition, if both of the conductances between the Faraday cup and ion gauge sections ($C_{f\text{-}g}$) and the outlet aperture conductance ($C_r$) are designed to be much greater than the inlet aperture conductance ($C_f$) then:

$$C_{f\text{-}g}>>C_f, \quad \text{Condition 3}$$

and $$C_r>>C_f, \quad \text{Condition 4}$$

and the expression for the equivalent molecular mass flow into the detector may be further approximated. The reduced expression is:

$$Q_{in}=P_gC_r \quad \text{Eqn. 7}$$

In the preferred embodiment for this invention conditions 1, 2, 3, and 4 are chosen so that Eqn. 7 is applicable, and the quantity $Q_{in}$ is estimated by the product of the pressure measurement in the pressure sensor 224 and the (measured or calculated) conductance $C_r$. In situations where it may not be desirable or practical to satisfy all of conditions 1, 2, 3, and 4, then Eqn. 5 or Eqn. 6 may be used and it may be necessary to measure or calculate additional conductances and to additionally measure the background pressure $P_b$ to calculate $Q_{in}$.

Let $C_{r0}$ be the constant value of $C_r$ calculated or measured at a particular reference temperature $T_0$, then since $C_r$ is a function of the average molecular velocity in the gas and since the average molecular velocity is a function of the square root of the absolute temperature T, it follows that at any temperature, T:

$$Q_{in} = P_gC_{r0}\sqrt{\frac{T}{T_0}}, \quad T \text{ and } T_0 \text{ both in } K \quad \text{Eqn. 8}$$

Since the impact of energetic clusters in the Faraday cup results in essentially complete dissociation of the clusters into their constituent molecules, the expression for $Q_{in}$ can be converted into the number of molecules per ion.

Then:

$$\overline{N} = \left(\frac{\text{mean number of molecules}}{\text{ion}}\right) = \frac{(Q_{in}A_n)/(P_sV_s)}{I/e} \quad \text{Eqn. 9}$$

and $$\overline{N} = \frac{P_gA_nC_{r0}e}{P_sV_sI}\sqrt{\frac{T}{T_0}} \text{ molecules} \quad \text{Eqn. 10}$$

where $Q_{in}$ is in torr-liters/sec; $P_g$ is in torr; $C_{r0}$ is the conductance of the exit aperture in liters/sec calculated for or measured at a reference temperature $T_0$ (in degrees K); T (in degrees K) is the temperature of the gas exiting the pressure sensor exit aperture; $A_n$ is Avogadro's number ($6.02\times10^{23}$ molecules/gram-mole); $P_s$ is 760 (torr) and $V_s$ is 22.4 (liters/gram-mole), standard pressure and standard volume of a gram-mole at standard temperature; I is the ion current (coulombs/sec); and e is the electronic charge ($1.602\times10^{-19}$ coulombs). The temperature T can be approximated by the temperature of the pressure sensor enclosure.

It is important to note that since the GCIB entering the detector may contain both non-ionized molecules and clusters and ionized molecules and clusters, the pressure $P_g$ measured by the gauge has three components:

$$P_g=P_b+P_i+P_n \quad \text{Eqn.11}$$

where $P_i$ is the component due to the ionized molecules and clusters in the measured GCIB, and $P_n$ is the component due to the unionized (neutral) molecules and clusters in the measured GCIB.

$P_b$ is the background pressure as previously defined and according to Condition 1, is much smaller than $P_g$. Thus, $P_g$ may be approximated by the simpler expression:

$$P_g=P_i+P_n \quad \text{Eqn.12}$$

The value for $\overline{N}$ given in Eqn. 10 is the mean number of molecules (both ionized and unionized) per ion. Equation 13 gives the number of molecules (ionized only) traveling in the GCIB per ion and is a measure of the mean size of ionized clusters (including ionized clusters of size N=1):

$$\overline{N}_i = \left(\frac{\text{mean number of molecules in ions}}{\text{ion}}\right) = \frac{P_iA_nC_{r0}e}{P_sV_sI}\sqrt{\frac{T}{T_0}} \quad \text{Eqn. 13}$$

and $$\overline{N}_i = \left(\frac{\text{mean number of molecules in neutrals}}{\text{ion}}\right) = \frac{P_nA_nC_{r0}e}{P_sV_sI}\sqrt{\frac{T}{T_0}} \quad \text{Eqn. 14}$$

and from Eqns. 12 and 13:

$$\overline{N}_i = \frac{(P_g-P_n)A_nC_{r0}e}{P_sV_sI}\sqrt{\frac{T}{T_0}} = \overline{N}-\overline{N}_n \text{ molecules} \quad \text{Eqn. 15}$$

By separately measuring $\overline{N}$ and $\overline{N}_n$ and taking their difference, it is possible to determine $\overline{N}_i$. $\overline{N}$ is determined by measuring the full GCIB including all ionized and unionized particles. $\overline{N}_n$ may be determined by removing all charged particles from the GCIB and then using the detector to measure $\overline{N}_n$. $\overline{N}_i$ may then be determined by Eqn. 15. Of course it is recognized that rather than measuring $\overline{N}$ and $\overline{N}_n$ and taking their difference to determine $\overline{N}_i$, it is equally possible and appropriate to measure $\overline{N}$ and $\overline{N}_i$, and taking their difference to determine $\overline{N}_n$. It only requires a different arrangement of detector and charged beam switch from that described hereinafter and will occur readily to those of average skill in the art of charged beam transport.

Figure 7:
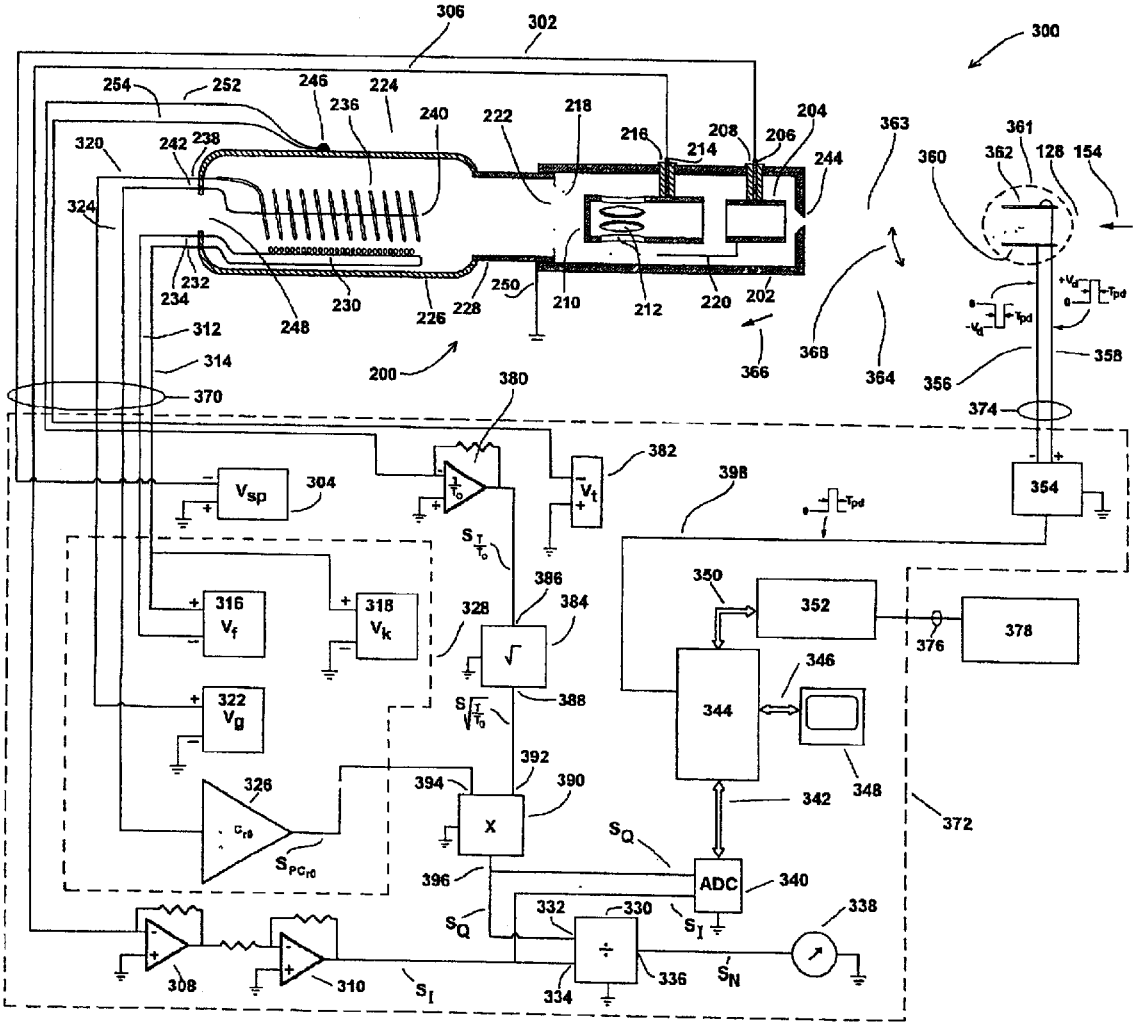
FIG. 7 is a schematic diagram of an ionized cluster beam charge and mass measurement system of the invention.

In FIG. 7, a schematic diagram 300 shows preferred circuitry to support the use of the detector apparatus 200, though other circuits may also be employed. A dotted line encloses support circuitry 372 for use with the detector apparatus 200. Included is means for separately determining $\overline{N}$, $\overline{N}_i$, and $\overline{N}_n$. A GCIB 128, (which may include ionized and unionized clusters and molecules) has an initial trajectory 154 that is directed at the entrance aperture 244 of detector apparatus 200. The metal shield 202 of the detector apparatus 200 is electrically grounded through electrical connector 250. The suppressor electrode 204 of the detector apparatus is electrically connected through electrical connector 206 and lead 302 to a suppressor power supply 304 that biases the suppressor electrode 204 negative of ground by a potential $V_{SP}$ that is typically 350 to 1000 volts. The Faraday cup 210 of the detector apparatus is electrically connected through electrical connector 214 and lead 306 to the input of current-to-voltage converter 308. The input of current-to-voltage converter 308 is a virtual ground. The output of current-to-voltage converter 308 connects to the input of amplifier 310 that produces an output signal voltage $S_i$ which is representative of the ion current collected in Faraday cup 210.

The spiral anode grid 236 of the pressure sensor 224 of the detector apparatus 200 is electrically connected through electrical connector 238 and lead 320 to an anode grid power supply 322 that biases the spiral anode grid 236 positive of ground by a potential $V_g$ that is typically 140 to 300 volts. The filament 230 of the pressure sensor 224 is electrically connected through electrical connectors 232 and 234 and through leads 312 and 314 to a filament power supply 316 that provides filament heating current by means of a voltage bias $V_f$ that is typically 1.5 to 3.0 volts. Lead 314 additionally connects the positive end of the filament power supply 316 and the filament 230 to a cathode power supply 318 that biases the positive end of the filament 230 positive of ground by a voltage $V_k$ that is typically 20 to 50 volts. The collector electrode 240 of the pressure sensor 224 is electrically connected through electrical connector 242 and lead 324 to the input of electrometer amplifier 326, which has an input that is at virtual ground. Electrometer amplifier 326 is a current-to-voltage converter that has a gain proportional to $C_{r0}$ (as defined for Eqn. 8) so as to produce a output voltage signal $S_{PCr0}$ that is proportional to the product $P_g \times C_{r0}$, where $P_g$ is the pressure within pressure sensor 224. The functions enclosed in dotted line 328 comprise the typical functions provided in a conventional ionization vacuum gauge controller. Thus it is possible to substitute a commercial ionization vacuum gauge controller such as Granville-Phillips Series 330 Ionization Gauge Controller for the elements within dotted line 328. Temperature sensor 246 of detector apparatus 200 is electrically connected by lead 254 to temperature sensor power supply 382 that biases the temperature sensor negative of ground by a potential $V_t$ that is typically 4 to 30 volts. Temperature sensor 246 is also electrically connected by lead 252 to current-to-voltage converter 380 that has a gain proportional to $$\frac{1}{T_0}$$

so that its output is a voltage signal $S_{T/To}$ that is proportional to $$\frac{T}{T_0},$$

where T is the temperature of the pressure sensor enclosure 226 and $T_0$ is a reference temperature as defined for Eqn. 8. Signal $S_{T/To}$ that is proportional to $$\frac{T}{T_0}$$

is connected to input 386 of square root module 384. Square root module 384 has an output 388 that provides a signal $S_{\sqrt{T/To}}$ that is proportional to $$\sqrt{\frac{T}{T_0}}.$$

Signal $S_{\sqrt{T/To}}$ connects to multiplier input 392 of multiplier module 390. Signal $S_{PCr0}$ from electrometer amplifier 326 connects to multiplicand input 394 of multiplier module 390. Multiplier module 390 has an output 396 where it produces a signal $S_Q$ proportional to $Q_{in}$ (as in Eqn. 8). Signal $S_Q$ connects to dividend input 332 of dividing module 330 and also connects to a first input of two channel analog-to-digital converter 340 for inputting to a digital processing and control system 344. Signal $S_I$ from amplifier 310 connects to divisor input 334 of dividing module 330 and also connects to a second input of two channel analog-to-digital converter 340 for inputting to a digital processing and control system 344. Dividing module 330 has an output 336 that produces a voltage signal $S_N$ proportional to $\overline{N}$ (as in Eqn.10). Signal $S_N$ connects to and is displayed by visual display device 338, which has a gain and scale calibration to present N in units of mean number of molecules per ion.

Since GCIB 128 may contain both ionized and unionized clusters and molecules, in order to determine $\overline{N}$, $\overline{N}_i$, and $\overline{N}_n$, the invention provides means for switching the charged (ionized) portion of the GCIB 128 in order to separate it from the unionized portion of the GCIB 128. A pair of electrostatic deflection plates 360 and 362 are disposed about the axis of the GCIB 128 upstream of the entrance aperture 244 of the detector apparatus 200 so as to act as a charged beam switch 361 (a beam switch for the charged portion of the beam). A deflection signal generator 354 has a positive-going output electrically connected to deflection plate 362 via lead 358 and a negative-going output electrically connected to deflection plate 360 via lead 356. Normally, the positive-going and negative-going outputs of deflection signal generator 354 are both at zero (ground) potential and the deflection plates 360 and 362 have no effect on the GCIB 128, so ionized and unionized portions of the GCIB follow initial trajectory 154 and enter the entrance aperture 244 of the detector apparatus 200. Under these conditions, the signal $S_N$ produced at the output of dividing module 336 represents $\overline{N}$ (Eqn. 9 and Eqn. 10). Signal $S_Q$, inputted to the first input of dual channel analog-to-digital converter 340, represents $$P_g C_{r0} \sqrt{\frac{T}{T_0}},$$

and signal $S_I$, inputted to the second input of dual channel analog-to-digital converter 340, represents I, the ion current. A cable 370 contains leads and cables from detector apparatus 200 to support circuitry 372.

Deflection signal generator 354 may be actuated by digital processing and control system 344, which may be a specialized controller or may be a small general-purpose computer for general control of a GCIB processing system. Deflection signal generator 354 is actuated when the digital processing and control system 344 sends a logic pulse on control line 398 to deflection signal generator 354. The actuating control logic pulse signal has a pulse width of $T_{pd}$. The deflection signal generator responds to the actuating logic control signal by producing deflection signals. When the deflection signal generator 354 is actuated, its positive-going output produces a positive pulse having a voltage level of $+V_d$ and a duration of $T_{pd}$ concurrent with the logic pulse, and its negative-going output produces a negative pulse having a voltage level of $-V_d$ and a concurrent duration of $T_{pd}$. $V_d$ is typically several hundred to a few thousand volts and is chosen so as to enable the charged beam switch 361, producing a deflection of the charged (ionized) portion of GCIB 128 away from initial trajectory 154 to a new trajectory 366 so that the charged beam makes an angle 368 with the uncharged (unionized) portion of the beam 363, which continues on the original trajectory 154 and enters the entrance aperture 244 of detector apparatus 200. During the time period $T_{pd}$, when the deflection signal generator is actuated, the deflector plates 360 and 362 receive deflection voltages $-V_d$ and $+V_d$ respectively, thus enabling charged beam switch 361. With charged beam switch 361 enabled, only the uncharged portion 363 of the GCIB 128 enters the detector apparatus 200 and the charged portion 364 of the GCIB 128 is deflected by angle 368 to trajectory 366 and does not enter the detector apparatus 200. When the deflection signal generator 354 is not actuated, the deflector plates 360 and 362 do not receive deflection voltages $-V_d$ and $+V_d$ and are grounded, thus disabling charged beam switch 361. With charged beam switch 361 disabled, the entire GCIB 128, charged and uncharged (ionized and unionized), enters the detector apparatus 200. A cable 374 contains leads from charged beam switch 361 to deflection signal generator 354, which is part of support circuitry 372.

Digital processing and control system 344 is connected to analog-to-digital converter 340 through bus 342 and receives input data from analog-to-digital converter 340 as previously described. Digital processing and control system 344 calculates values for some or all of $\overline{N}$, $\overline{N}_i$, and $\overline{N}_n$ and displays these values on visual display unit 348, which is connected to digital processing and control system 344 by bus 346. Digital processing and control system 344 is connected to interface circuitry 352 by bus 350. Interface circuitry 352 connects by cable 376 to controlled and sensed portions of a GCIB processing system 378. Digital processing and control system 344 may be a general-purpose computer that also controls other aspects of a GCIB processing system 378.

Figure 8:
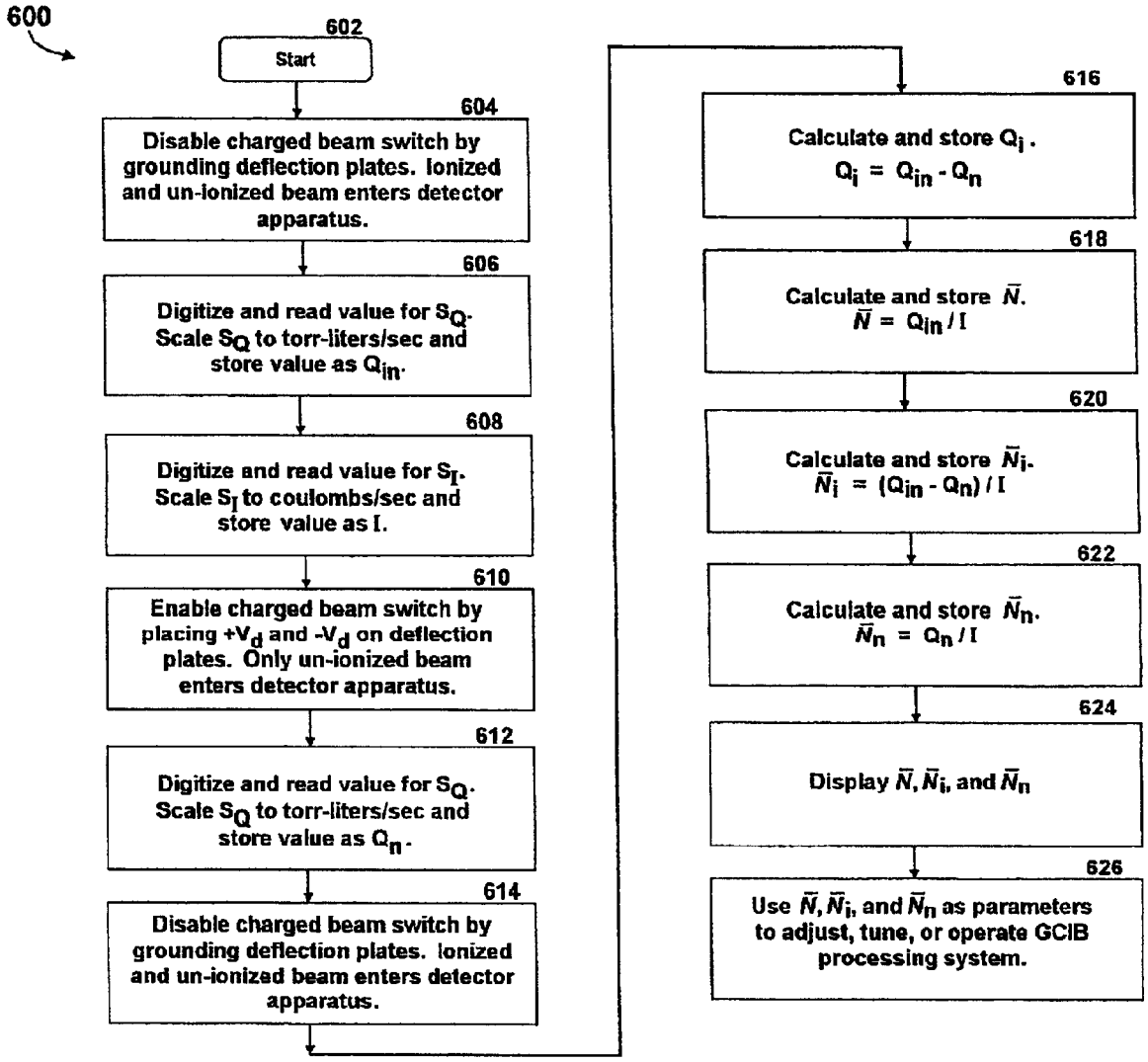
FIG. 8 is a flowchart showing data acquisition, calculation, display, and GCIB processing system control in the invention.

The method by which digital processing and control system 344 reads signal inputs from the detector apparatus 200 and uses the inputs to calculate some or all of $\overline{N}$, $\overline{N}_i$, and $\overline{N}_n$ and displays some or all of $\overline{N}$, $\overline{N}_i$, and $\overline{N}_n$ and uses some or all of $\overline{N}$, $\overline{N}_i$, and $\overline{N}_n$ in control functions for a GCIB processing system 378 is shown in flowchart 600 in FIG. 8. The process begins at step 602. At step 604, the charged beam switch 361 is disabled by digital processing and control system 344. This allows all of GCIB 128 (including ionized and unionized components) to enter the detector apparatus 200. At step 606, digital processing and control system 344 reads and digitizes signal $S_Q$ through analog-to-digital converter 340. Digital processing and control system 344 then scales the digitized value of signal $S_Q$ by multiplying it by a predetermined constant to convert it to units of torr-liters/sec and stores the value internally as $Q_{in}$. Next at step 608, digital processing and control system 344 reads and digitizes signal $S_I$ through analog-to-digital converter 340. Digital processing and control system 344 then scales the digitized value of signal $S_I$ by multiplying it by a predetermined constant to convert it to units of coulombs/sec and stores the value internally as I. Next at step 610, the charged beam switch 361 is enabled by digital processing and control system 344. This switches the charged (ionized) portion 364 out of the GCIB 128 so that only the uncharged (unionized) portion 363 of the GCIB 128 enters the detector apparatus 200. At step 612, digital processing and control system 344 reads and digitizes signal $S_Q$ through analog-to-digital converter 340. Digital processing and control system 344 then scales the digitized value of signal $S_Q$ by multiplying it by a predetermined constant to convert it to units of torr-liters/sec and stores the value internally as $Q_n$. At step 614, the charged beam switch 361 is disabled by digital processing and control system 344. This allows all of GCIB 128 (including ionized and unionized components) to enter the detector apparatus 200. At step 616, digital processing and control system 344 calculates and stores $Q_i=Q_{in}-Q_n$. At step 618, digital processing and control system 344 calculates and stores $\overline{N}=Q_{in}/I$. At step 620 digital processing and control system 344 calculates and stores $\overline{N}_i=(Q_{in}-Q_n)/I$ . At step 622, digital processing and control system 344 calculates and stores $\overline{N}_n=Q_n/I$. At step 624, digital processing and control system 344 displays some or all of $\overline{N}$, $\overline{N}_i$, and $\overline{N}_n$ on visual display device 348. At step 626, digital processing and control system 344 uses some or all of the values measured for $\overline{N}$, $\overline{N}_i$, and $\overline{N}_n$ to control the output of signals to optimize the operation of a GCIB processing system. Signals are outputted via bus 350 through interface circuitry 352 and cable 376 to control elements of GCIB processing system 378. Typically, such controlled elements are elements capable of adjusting, affecting, or regulating the values of $\overline{N}$, $\overline{N}_i$, and $\overline{N}_n$. The steps of flowchart 600 can be repeated periodically or in response to a specific command or triggering event in order to facilitate closed loop regulation of $\overline{N}$, $\overline{N}_i$, and $\overline{N}_n$ using proportional-integral-derivative (PID) or other control algorithms known to those skilled in the art of closed loop process control.

Figure 9:
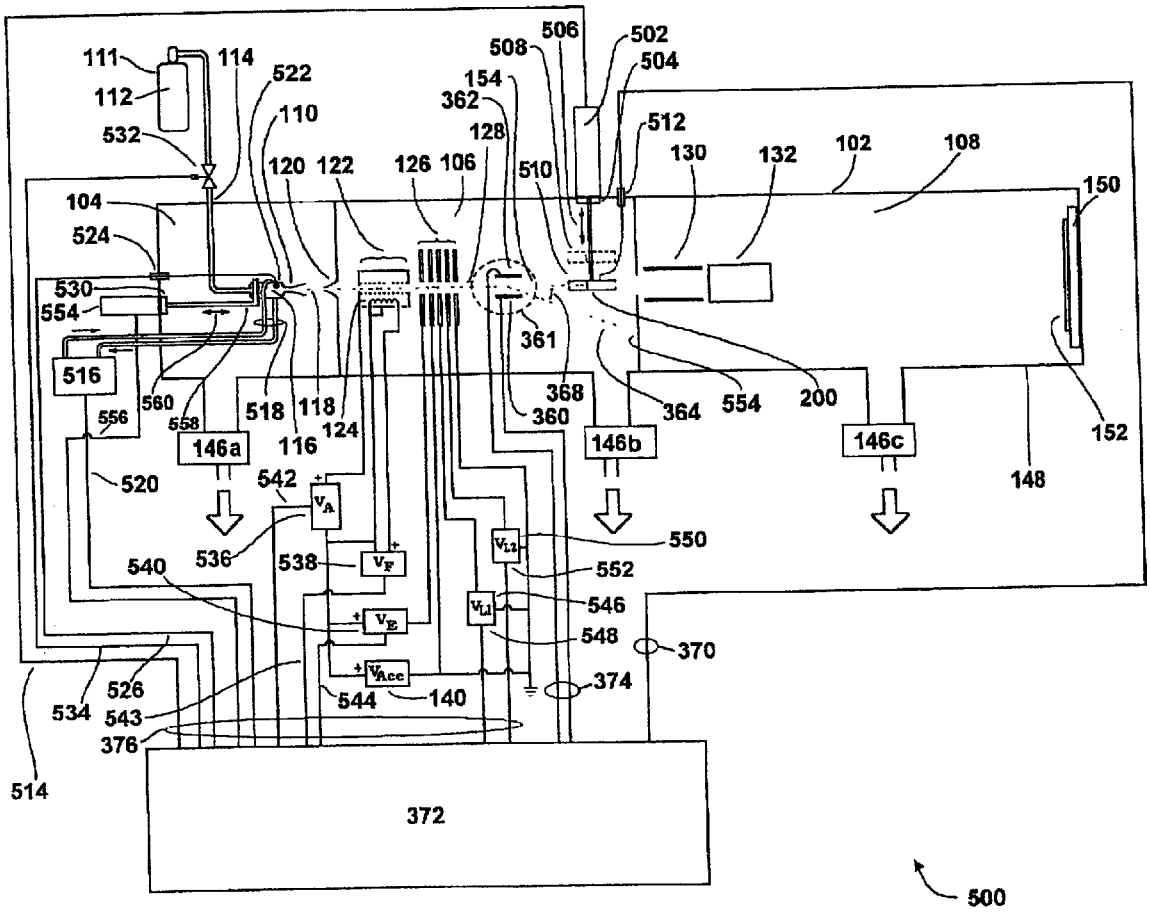
FIG. 9 is a schematic representation of a GCIB processing system of this invention showing the detector apparatus positioned for sensing the GCIB.

FIG. 9 shows the GCIB processing system 500 of this invention as an example of a controlled GCIB processing system 378. Referring to FIG. 9, support circuitry 372 and cables 376 and 374 and 370 correspond to those like-designated elements of schematic diagram 300, which is shown in FIG. 7. Cable 370 electrically connects detector apparatus 200 to support circuitry 372. Cable 374 connects charged beam switch 361 to support circuitry 372 and cable 376 connects controlled GCIB processing system 378 to support circuitry 372. Controlled GCIB processing system 378 has several elements that may be controlled or adjusted by the support circuitry 372.

A linear actuator 502 having a vacuum motion feedthrough 504 supports detector apparatus 200 and can dispose it in either of a beam intercepting position 510 (shown in solid lines) or in a stored position 508 (shown in dotted lines) as a consequence of controllably reciprocating linear motion 506. Linear actuator 502 has a cable 514 electrically connecting it through cable 376 to support circuitry 372 for conducting control signals for actuating linear actuator 502. An electrically controllable gas control valve 532 has a cable 534 electrically connecting it through cable 376 to support circuitry 372 for controllably adjusting the source gas stagnation pressure in stagnation chamber 116 to affect the mean gas cluster size in supersonic gas jet 118. An electrically controllable heated/chilled fluid circulator 516 connected to a heated/chilled fluid circulation loop 518 is electrically connected through cable 520 and through cable 376 to support circuitry 372 for control. Heated/chilled fluid circulation loop 518 is in thermal contact with the stagnation chamber 116 and nozzle 110 to facilitate control or adjustment of stagnation chamber 116 and nozzle 110 temperature to affect the mean gas cluster size in supersonic gas jet 118. A temperature sensor 522 is in thermal contact with stagnation chamber 116 and is electrically connected through vacuum electrical feedthrough 524 and cable 526 and cable 376 to support circuitry 372 to facilitate closed loop regulation of the temperature of stagnation chamber 116 to affect the mean gas cluster size in supersonic gas jet 118. A linear actuator 554 having a vacuum motion feedthrough 530 has a linkage 558 that actuates stagnation chamber 116 together with nozzle 110 in order to position nozzle 110 an adjustable and controllable axial distance from gas skimmer aperture 120 by means of linear motion 560. Linear actuator 554 has a cable 556 electrically connecting it through cable 376 to support circuitry 372 for conducting control signals for actuating linear actuator 554 in order to affect or adjust the mean gas cluster ion size and the ratio of cluster ions to molecular ions in GCIB 128. Filament power supply 538 is electrically controllable and connects electrically through cable 543 and cable 376 to support circuitry 372. Filament power supply 538 controllably provides voltage $V_F$ to heat the ionizer filament 124 so as to adjust or control the ionized fraction of the GCIB 124, which also affects the mean cluster size. Anode power supply 536 is electrically controllable and connects electrically through cable 542 and cable 376 to support circuitry 372. Anode power supply 536 provides controllable voltage $V_A$ to accelerate thermoelectrons emitted from filament 124 to adjust or control the ionized fraction of and mean cluster size of GCIB 124. Extraction power supply 540 is electrically controllable and connects electrically through cable 544 and cable 376 to support circuitry 372. Extraction power supply 540 provides controllable voltage $V_E$ to affect the mean cluster size in GCIB 128. One or more electrically controllable lens power supplies (546 and 550 shown for example) connect electrically through cables 548 and 552 respectively and through cable 376 to support circuitry 372 and provide controllable voltages to bias high voltage electrodes with potentials ($V_{L1}$ and $V_{L2}$ for example) to focus the GCIB 128 and to affect the mean cluster size in GCIB 128. Charged beam switch 361 having deflection plates 360 and 362 connects through cable 374 to support circuitry 372 so as to controllably switch charged beam portion 364 away from initial trajectory 154 and so as to strike at a point 554 that is removed from beam intercepting position 510 of detector apparatus 200.

Figure 10:
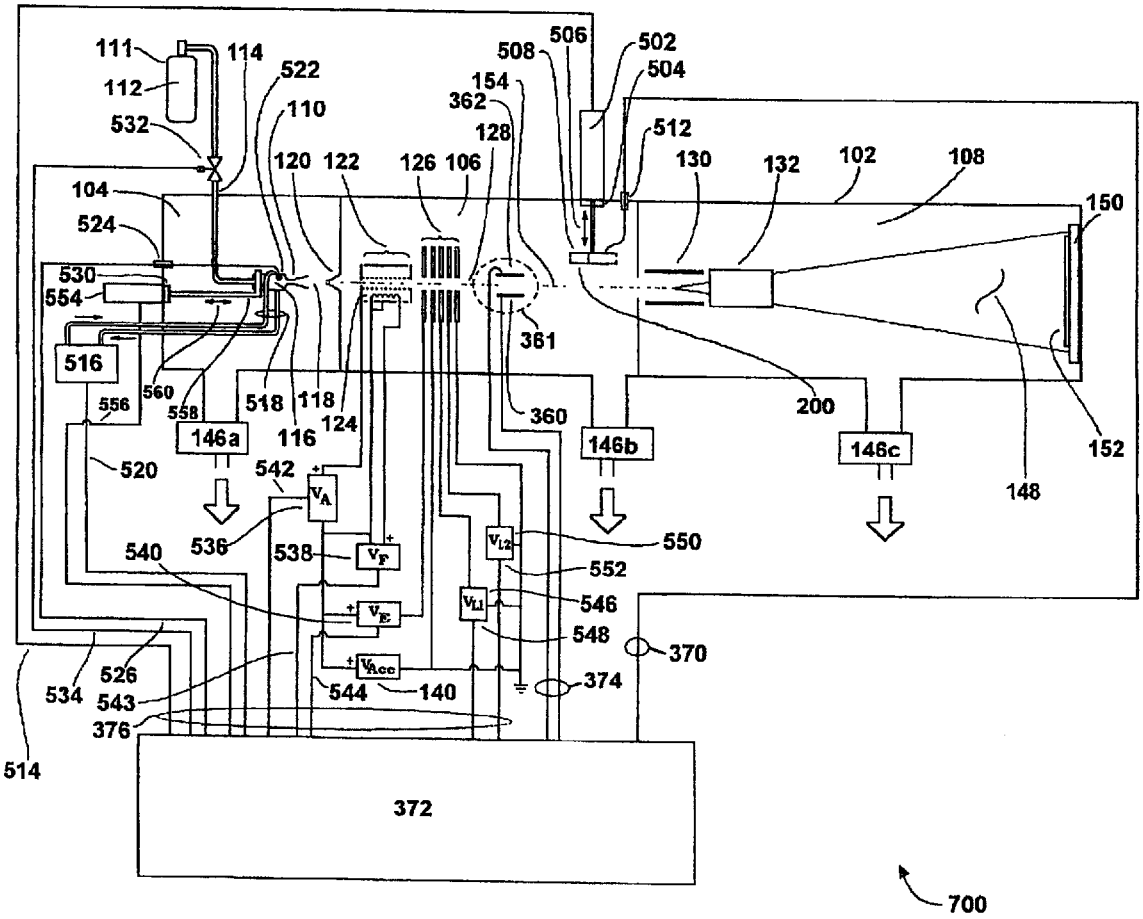
FIG. 10 is a schematic representation of the GCIB processing system of this invention, shown with the detector apparatus removed from the beam path during beam processing.

In GCIB processing system 500 as shown in FIG. 9, detector apparatus 200 is shown in beam intercepting position 510 where it controllably measures the mean cluster sizes in GCIB 128. In FIG. 10, GCIB processing system 700 shows detector apparatus 200 positioned in stored position 508, permitting GCIB 128 to continue through electrostatic scan plates 130 and 132, forming scanned GCIB 148 and striking workpiece 152 disposed in the beam path for GCIB processing with GCIB having known or controlled mean cluster sizes.

Although the invention has been described with respect to various embodiments, it should be realized this invention is also capable of a wide variety of further and other embodiments within the spirit and scope of the appended claims.

What is claimed is:

1. A gas cluster ion beam detector for measuring the properties of a gas cluster ion beam comprising:

an enclosure having a first opening where the gas cluster ion beam enters the detector;

a dissociating means located within said enclosure adjacent to said first opening for dissociating gas cluster ions in the gas cluster ion beam into molecules;

a charge measuring means located within said enclosure for measuring the gas cluster ion beam current; and a pressure measuring means located with said enclosure for measuring the pressure within said enclosure.

2. The detector of claim 1 wherein said enclosure has a second opening through which the molecules exit the detector.

3. The detector of claim 2 wherein said first opening has a conductance and said second opening has a higher conductance than said first opening.

4. The detector of claim 3 wherein said higher conductance of said second opening is at least ten times greater than the conductance of said first opening.

5. The detector of claim 1 wherein said dissociating means is a solid surface that the gas cluster ions impact.

6. The detector of claim 5 wherein said solid surface is a surface of a Faraday cup.

7. The detector of claim 1 wherein said pressure measuring means is an ionization gauge.

8. The detector of claim 1 wherein said charge measuring means is a Faraday cup.

9. The detector of claim 1 wherein the pressure inside said enclosure is higher than the pressure outside said enclosure.

10. The detector of claim 9 wherein the pressure outside said enclosure is less than one-tenth the pressure inside said enclosure.

11. The detector of claim 1 wherein the pressure measuring means comprises a temperature sensor.

12. The detector of claim 1 wherein the charge measuring means comprises:

a Faraday cup for collecting the gas cluster ion beam current, said Faraday cup having at least one bypass opening for the molecules to exit said Faraday cup and enter said pressure measuring means; and a suppressor electrode having an electrical bias located between said first opening and said Faraday cup which promotes an accurate collection of the gas cluster ion beam current.

13. The detector of claim 12 wherein the charge measuring means further comprises a suppressor screen located between said Faraday cup and said pressure measuring means for further promoting an accurate collection of the gas cluster ion beam current.

14. A gas cluster ion beam detector for measuring the properties of a gas cluster ion beam comprising:

an enclosure having a first opening where the gas cluster ion beam enters the detector;

a current collecting region located within said enclosure adjacent to said first opening comprising means for dissociating gas cluster ions in the gas cluster ion beam into molecules and charge measuring means for measuring the gas cluster ion beam current; and a pressure sensing region located within said enclosure having a pressure measuring means for measuring the pressure within said pressure sensing region.

15. The detector of claim 14 wherein said enclosure has a second opening adjacent to said pressure sensing region through which the molecules exit the detector.

16. The detector of claim 15 wherein said first opening has a conductance and said second opening has a higher conductance than said first opening.

17. The detector of claim 16 wherein said higher conductance of said second opening is at least ten times greater than the conductance of said first opening.

18. The detector of claim 14 wherein said dissociating means is a solid surface that the gas cluster ions impact.

19. The detector of claim 18 wherein said solid surface is a surface of a Faraday cup.

20. The detector of claim 14 wherein said pressure measuring means is an ionization gauge.

21. The detector of claim 14 wherein said charge measuring means is a Faraday cup.

22. The detector of claim 14 wherein the pressure inside said enclosure is higher than the pressure outside said enclosure.

23. The detector of claim 22 wherein the pressure outside said enclosure is less than one-tenth the pressure inside said enclosure.

24. The detector of claim 14 further comprising a temperature sensor.

25. The detector of claim 14 wherein the charge measuring means comprises:

a Faraday cup for collecting the gas cluster ion beam current, said Faraday cup having at least one bypass opening for the molecules to exit said Faraday cup and enter said pressure sensing region; and a suppressor electrode having an electrical bias located between said first opening and said Faraday cup which promotes an accurate collection of the gas cluster ion beam current.

26. The detector of claim 25 wherein the charge measuring means further comprises a suppressor screen located between said Faraday cup and said pressure sensing region for further promoting an accurate collection of the gas cluster ion beam current.

27. A gas cluster ion beam processing system comprising:

a source for producing a gas cluster ion beam, said gas cluster ion beam comprising ionized and unionized gas clusters;

a gas cluster ion beam detector that measures the properties of said gas cluster ion beam;

means for operably controlling the relationship between said gas cluster ion beam detector and said gas cluster ion beam; and beam switching means for selectively controlling said ionized and unionized portions of said gas cluster ion beam.

28. The processing system of claim 27 wherein said beam switching means selectively controls only said unionized gas clusters in said gas cluster ion beam into said detector.

29. The processing system of claim 27 wherein said beam switching means selectively controls only said ionized gas clusters in said gas cluster ion beam into said detector.

30. The processing system of claim 27 wherein said beam switching means selectively controls said ionized gas clusters in order for only said unionized gas clusters in said gas cluster ion beam to be directed into said detector.

31. The processing system of claim 27 wherein said means for operably controlling the relationship between said gas cluster ion beam detector and said gas cluster ion beam disposes said detector in the path of said gas cluster ion beam.

32. The processing system of claim 27 wherein said detector measures cluster size.

33. The processing system of claim 32 further comprising means for estimating a mean cluster size.

34. The processing system of claim 33 further comprising control means for adjusting parameters of the processing system based on the estimated mean cluster size.

35. A method of measuring the properties of a gas cluster ion beam comprising:

producing a gas cluster ion beam having gas cluster ions;

dissociating said gas cluster ions into molecules;

collecting the charge of said gas cluster ions;

measuring gas cluster ion beam current based upon the charge of said gas cluster ions;

detecting the pressure level associated with the dissociated molecules; and measuring gas cluster ion beam mass based upon the pressure level associated with the dissociated molecules.

36. The method of claim 35 wherein said dissociating step is accomplished by impacting said gas cluster ions on a solid surface.

37. The method of claim 35 wherein said dissociating step is accomplished by impacting said gas cluster ions on a surface of a Faraday cup.

38. The method of claim 35 wherein said measuring gas cluster ion beam current step uses a Faraday cup.

39. The method of claim 35 wherein said measuring gas cluster ion beam current step further comprises inhibiting the collection of free electrons.

40. The method of claim 35 wherein said measuring gas cluster ion beam mass step uses an ionization gauge.

41. The method of claim 35 wherein said measuring gas cluster ion beam mass step further comprises measuring the temperature level of the dissociated molecules.

42. A method of controlling a gas cluster ion beam processing system comprising:

producing a gas cluster ion beam with ionized and unionized gas clusters;

directing said gas cluster ion beam into a detector;

measuring the properties of said gas cluster ion beam; and adjusting parameters of said gas cluster ion beam processing system based on the measured properties.

43. The method of claim 42 wherein said directing step comprises the step of placing the detector in the path of said gas cluster ion beam.

44. The method of claim 43 wherein said directing step further comprises the step of directing only said unionized portion of said gas cluster ion beam into said detector.

45. The method of claim 44 wherein said directing step further comprises directing said ionized portion of said gas cluster ion beam away from said detector.

46. The method of claim 45 wherein the properties measured are gas cluster ion beam current and gas cluster ion beam mass.

47. The method of claim 45 wherein the properties measured further comprise gas cluster size.

48. The method of claim 45 wherein said measuring step further comprises estimating a mean cluster size.

49. The method of claim 42 wherein the properties measured are gas cluster ion beam current and gas cluster ion beam mass.

50. The method of claim 49 wherein the properties measured further comprise gas cluster size.

51. The method of claim 42 wherein said measuring step further comprises estimating a mean cluster size.

* * * * *